US006782817B2

(12) United States Patent
Izawa et al.

(10) Patent No.: US 6,782,817 B2
(45) Date of Patent: Aug. 31, 2004

(54) PRINTING MACHINE

(75) Inventors: Hideo Izawa, Sakura (JP); Yuichi Yamazaki, Higashi-Katsushika-gun (JP); Yasushi Katagiri, Kashiwa (JP)

(73) Assignee: Miyakoshi Printing Machinery Co., Ltd., Narashino (JP)

( * ) Notice: Subject to any disclaimer, the term of this patent is extended or adjusted under 35 U.S.C. 154(b) by 0 days.

(21) Appl. No.: 10/315,140

(22) Filed: Dec. 10, 2002

(65) Prior Publication Data

US 2003/0167943 A1 Sep. 11, 2003

(30) Foreign Application Priority Data

Mar. 8, 2002 (JP) ..... P2002-063744

(51) Int. Cl.[7] ..... B41F 13/06

(52) U.S. Cl. ..... 101/223; 101/222; 101/179; 101/180

(58) Field of Search ..... 101/216, 219, 101/220, 221, 222, 223, 225, 228, 179, 180

(56) References Cited

U.S. PATENT DOCUMENTS 865,728 A * 9/1907 Smith ..... 270/8
1,816,354 A * 7/1931 Barber ..... 101/179
3,906,855 A * 9/1975 Laursen ..... 101/223
6,050,191 A * 4/2000 Enderle et al. ..... 101/222
6,615,717 B1 * 9/2003 Perdu ..... 101/223
2002/0195008 A1 * 12/2002 Perdu ..... 101/223

FOREIGN PATENT DOCUMENTS

JP 2000-168035 6/2000

* cited by examiner

*Primary Examiner*—Andrew H. Hirshfeld
*Assistant Examiner*—Kevin D. Williams
(74) *Attorney, Agent, or Firm*—Wenderoth, Lind & Ponack, L.L.P.

(57) ABSTRACT

A printing machine includes two printing units, each comprising a web feed section, a web printing section connected to the web feed section and a web treating section connected to the web printing section, in which a single-side surface of a continuous web is printed at each of the web printing sections. The printing machine also includes a turn/transfer section at which two the printing units are operatively connected and the continuous web printed by one of the two web printing sections is transferred to the other one thereof through turning and transferring treatment of the continuous web. The printing machine is capable of carrying out double-side printing and single side printing and improving printing efficiency with a relatively small location space or site.

7 Claims, 2 Drawing Sheets

PRINTING MACHINE

BACKGROUND OF THE INVENTION

1. Field of the Invention

The present invention relates to a printing machine capable of selectively performing double-side (perfect) printing and single-side (simple) printing on a continuous web of paper (called "continuous web" or merely "web" hereinafter).

2. Description of the Related Art

A conventional printing machine of the kind mentioned above includes, for example, a double-side surface printing machine in which two printing units are disposed, via a turning device for changing a side of the web to be printed, on a traveling path for the continuous web, in which a single-side surface of the web is printed by one of these two printing units. Then the web is turned by a turning device, and the other single-side surface thereof is thereafter printed by the other one of the two printing units, thus performing double-side (perfect) printing.

Another conventional example of such a printing machine is disclosed in Japanese Patent Laid-open (KOKAI) Publication No. 168035/2000 utilizing two printing units, in which web traveling paths in these two printing units are continuously connected so as to provide a hook shape or to be in parallel to each other in such a manner that a terminal end of a preceding printing unit is arranged to be continuously connected to a starting end of another succeeding printing unit through a turn-bar mechanism. According to such a printing machine, a single-side surface of the continuous web is printed by one printing unit and, thereafter, the web is turned by the turn-bar mechanism, and then the other single-side surface is printed by the other printing unit.

However, in the conventional printing machine of the structure mentioned above in the former example, in a case where only single-side surface printing is required on one continuous web, one of two printing units is not used, and hence, in such a case, the printing rate is made worse and deteriorated, and thus becomes rather inconvenient.

On the other hand, in the later mentioned conventional example, single-side surface printing can be performed by each of these two printing units, so that the printing machine is suitably applicable as a single-side printing unit. However, the two printing units in this example are arranged so as to be in hook-shape or in parallel to each other, so that a large amount of location space is needed.

SUMMARY OF THE INVENTION

The present invention was conceived to substantially eliminate the defects or inconveniences encountered in the prior art machines mentioned above and provides a printing machine including two printing units capable of carrying out double-side surface printing, and in the case of single-side surface printing, both printing units can be utilizedas single-side surface printing units, to thereby improve printing efficiency with a relatively small location space or site.

This and other objects can be achieved according to the present invention by providing, in a main aspect, a printing machine comprising:

two printing units, each comprising a web feed section, a web printing section connected to the web feed section and a web treating section as like as a web wind-up section connected to the web printing section, in which single-side surface of a continuous web is printed at each of the web printing sections; and a turn/transfer section formed between the web printing section and the web treating section of one of the printing units, for turning and transferring the continuous web, which is printed by one of two web printing sections, to the other one thereof through turning and transferring operation of the continuous web.

In another aspect of the present invention, there is also provided a printing machine comprising:

first and second printing units, the first and second printing units comprising first and second web feed sections, first and second web printing sections connected to the first and second web feed sections, respectively, and first and second web treating sections connected to the first and second web printing sections, respectively, in which single-side surface of a continuous web is printed at each of the first and second web printing sections; and a turn/transfer section formed at an intersecting portion between a first portion between the first web printing section and the first web treating section and a second portion between the second web feed section and the second web printing section, in which the continuous web printed at the first web printing section of the first printing unit is turned and transferred in a cross-over manner to the web second printing section of the second printing unit.

In a further aspect of the present invention, there is also provided a printing machine comprising:

first and second printing units, the first and second printing units comprising first and second web feed sections, first and second web printing sections connected to the first and second web feed sections, respectively, and first and second web treating sections connected to the first and second web printing sections, respectively, in which single-side surface of a continuous web is printed at each of the first and second web printing sections, wherein each of the first and second web feed sections of the first and second printing units is arranged at a portion on single-side in a direction perpendicular to a printing direction in the web printing section through one turning bar and each of the first and second web treating sections of the first and second web printing units is arranged at a portion on another single-side in the direction perpendicular to the printing direction in the printing section through another turning bar; and a turn/transfer section formed at a connecting portion between the first and second web printing sections which are arranged on a same linear line, so as to transfer the continuous web printed at the first web printing section of the first printing unit to the second web printing section of the second printing unit as it is or in a turned state.

In the printing machines mentioned above, each of the first and second web printing sections includes a printing device and a drier disposed on a downstream side of the printing device.

The first and second printing units may be driven sectionally synchronously or independently.

According to the printing machine having the characteristics mentioned above, two, i.e. first and second, printing units perform the single-side printing operations independently. By utilizing the turn/transfer section, the continuous web which has been printed on a single-side surface at the one (first) printing section of one (first) printing unit is turned and transferred, in the cross-over manner, by the turn/transfer section, to the other (second) printing section of the other (second) printing unit, at which the other single-side surface is printed, thus double-side surfaces are printed.

Therefore, according to the printing machine of the present invention, in which single- or double-side printing operations can be selectively performed, two printing units can be independently utilized to thereby improve the driving (working) performance of the printing machine.

Furthermore, according to the arrangement in which there is disposed the turn/transfer section between the printing section and the continuous web feed section of one of the printing units so as to turn and transfer the continuous web, printed by the printing section, to the printing section of the other of the printing units, both the printing units intersect at their intermediate portions, thus making compact the printing machine itself and hence reducing the necessary installation space.

Particularly, in the arrangement in which the web feed section is disposed on a single side in the perpendicular direction to the printing section and the continuous web treating section is disposed on the other side in the perpendicular direction of the printing unit, the installation space can be further minimized.

The above and other objects, and nature and further characteristic features of the present invention will be made more clear from the following descriptions made with reference to the accompanying drawings.

DESCRIPTION OF THE PREFERRED EMBODIMENTS

Preferred embodiments of the present invention will be described hereunder with reference to the accompanying drawings.

Figure 1:
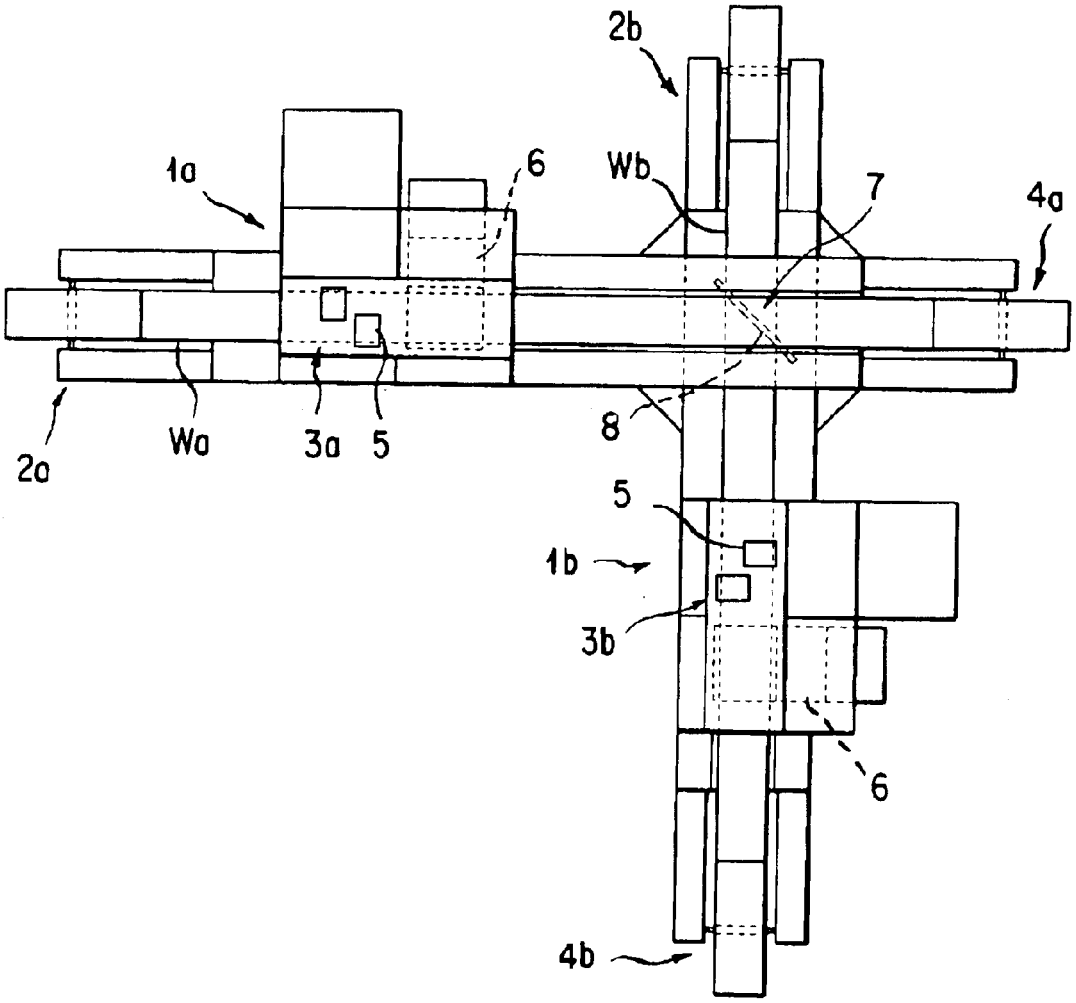
FIG. 1 is a plan view schematically showing a printing machine according to a first embodiment of the present invention.

With reference to FIG. 1, showing the first embodiment of the present invention, a printing machine of this embodiment includes a first printing unit la and a second printing unit 1*b*, which are provided with web feed sections 2*a*, 2*b*, web printing sections 3*a*, 3*b* and web wind-up (roll-up) sections 4*a*, 4*b*, respectively.

Continuous webs of paper (hereinafter called "continuous web" or merely "web") fed from the wet feed sections 2*a* and 2*b* are printed respectively at the web printing sections 3*a* and 3*b* and then wound up at the web wind-up sections 4*a* and 4*b*. The printing sections 3*a* and 3*b* include printing devices 5 and dryers 6 which are disposed on a downstream side of the printing devices 5 in the web feed direction.

The first printing unit 1*a* includes a traveling path having a predetermined length between the printing section 3*a* and the wind-up section 4*a*, and on the other hand, the second printing unit 1*b* includes a traveling path having a predetermined length between the web feed section 2*b* and the printing section 3*b*. Both of these traveling paths are arranged so as to intersect at a right angle with each other, and the intersecting portion is formed as turn/transfer section 7.

This turn/transfer section 7 is provided with a turning bar 8 for turning a continuous web Wa traveling on the traveling path of the first printing unit 1*a* and the turned continuous web Wa is then transferred to the traveling path of the second printing unit 1*b* to thereby guide the web Wa to the printing section 3*b*.

Each of these printing units 1*a* and 1*b* is equipped with a driving servo-motor, for sectional driving, to be controlled by a drive-control device, not shown, to allow the printing units 1*a* and 2*b* to be driven so as to carry out the printing operations independently or synchronously with each other in an interlocking manner.

In the first embodiment of the arrangement described above, the continuous web Wa fed from the web feed section 2*a* of the first printing unit 1*a* passes through the printing section 3*a* of this first printing unit 1*a*, is then turned and bent by the turning bar provided in the turn/transfer section 7 and transferred to the traveling path of the second printing unit 1*b*. The continuous web Wa there after passes through the printing section 3*b* and the wind-up section 4*b*, and under this condition, both the printing units 1*a* and 1*b* are driven and controlled so as to carry out the synchronous operation, and thereby both sides of the continuous web Wa can be printed.

On the other hand, in the first printing unit 1*a*, the continuous web Wa is fed from the web feed section 2*a* to the web wind-up section 4*a* through the web printing section 3*a* without being subjected to any operation at the turn/transfer section 7.

Further, in the second printing unit 1*b*, the continuous web Wb is fed from the web feed section 2*b* to the web wind-up section 4*b* through the web printing section 3*b* without being subjected to any operation at the turn/transfer section 7. Under such condition, by individually driving both the printing units 1*a* and 1*b*, the continuous webs Wa and Wb are subjected to single-side surface printing, respectively.

Next, the second embodiment of the present invention will be described with reference to FIGS. 2 and 3.

Figure 2:
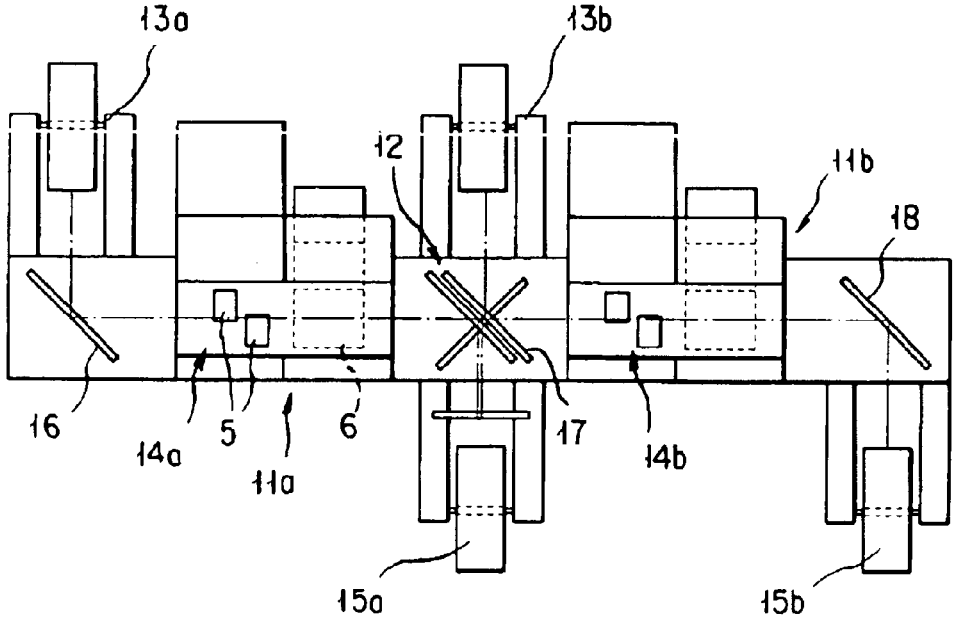
FIG. 2 is a plan view schematically showing a printing machine according to a second embodiment of the present invention.

Referring to FIG. 2, the printing machine of this second embodiment includes first and second printing units 11*a* and 11*b*, which are interlocked with each other by means of a turn/transfer section 12 at an intermediate step of the printing process of the printing units 11*a* and 11*b*.

The first printing unit 11*a* is provided with a first web feed section 13*a*, a first web printing section 14*a* and a first web wind-up section 15*a*, and on the other hand, the second printing section 11*b* is also provided with a second web feed section 13*b*, a second web printing section 14*b* and a second web wind-up section 15*b*.

The first and second printing sections 14*a* and 14*b* are arranged on the same line in series, and the turn/transfer section 12 is disposed between these first and second printing sections 14*a* and 14*b*.

The first web feed section 13*a* is disposed on a single-side position approximately perpendicular to the web printing direction (i.e. web feed direction) on the upstream side of the first printing section 14*a* via a first web feed side turning bar 16. On the other hand, the second web feed section 13*b* is also disposed on that single-side position approximately perpendicular to the web printing direction (i.e. web feed direction) on the upstream side of the second printing section 14*b* via a second web feed side turning bar 17.

Furthermore, the first wind-up section 15*a* is disposed on the other single-side position approximately perpendicular to the web printing direction on the downstream side of the first printing section 14*a* via the turn/transfer section 12. On the other hand, the second wind-up section 15*b* is disposed on the other single-side position approximately perpendicular to the web printing direction on the downstream side of the second printing section 14*b* via the second turning bar 18.

Figure 3:
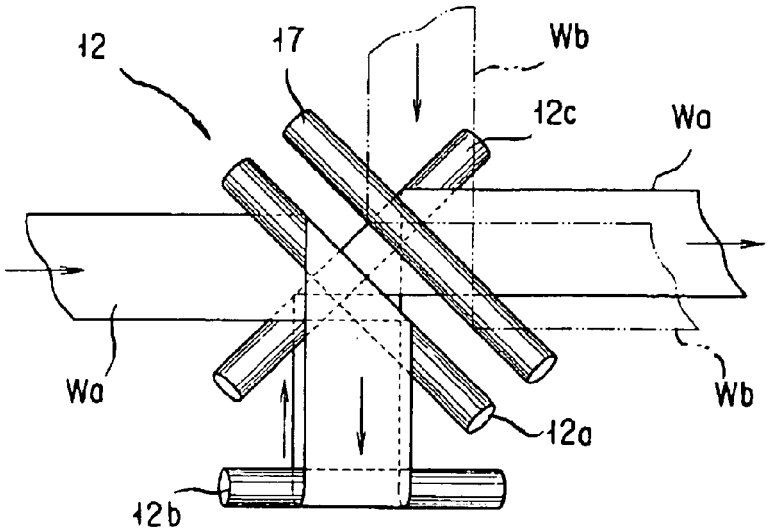
FIG. 3 is an illustration for explaining the construction and function of a turn/transfer mechanism of the second embodiment of FIG. 2.

With reference to FIG. 3, the turn/transfer section 12 is provided with a first turning bar 12*a* for turning, by 90 degrees, and then guiding the continuous web Wa from the first printing section 14*a* to the first wind-up section 15*a*, a second turning bar 12*b* for turning, by 180 degrees, the continuous web Wa guided by the first turning bar 12*a* and a third turning bar 12*c* for turning, by 90 degrees, and then guiding the continuous web Wb guided by the second turning bar 12*b* to the second printing section 14*b*.

In this second embodiment, it is possible to carry out (1) double-side (perfect) printing, (2) single-side (simple) printing and (3) single-side multi-color printing in the following manner.

(1) In the double-side printing, the continuous web Wa from the first web feed section 13*a* is turned by 90 degrees by the web feed side turning bar 16 to thereby pass the first printing section 14*a*. The continuous web Wa is then turned by 90 degrees by the first turning bar 12*a* of the turn/transfer section 12, again turned by 180 degrees by the second turning bar 12*b* and further turned by 90 degrees by the third turning bar 12*c* to thereby transfer the web Wa to the second printing unit 11*b*. Under this condition, the continuous web Wa is turned so that the back surface thereof is the upper side and is positioned on the printing line passing the first and second printing sections 14*a* and 14*b* with the back surface thereof being the exposed upper side, and the continuous web Wa in this state passes through the second printing section 14*b* and then through the second wind-up section 15*b* by way of the wind-up side turning bar 18.

Under the state mentioned above, when both the printing units 11*a* and 11*b* are driven, one surface (front surface) of the continuous web Wa, which is fed from the web feed section 13*a*, is printed by the first printing section 14*a* and the other one surface (back surface) thereof is then printed by the second printing section 14*b*, thus both surfaces of the continuous web Wa are printed.

(2) In the single-side printing, the continuous web Wa is fed from the first web feed section 13*a* of the first printing unit 11*a* and then turned by 90 degrees by the first web feed side turning bar 16 to thereby pass through the first printing section 14*a*. Thereafter, the continuous web Wa is turned by 90 degrees by the first turning bar 12*a* of the turn/transfer section 12 to pass through the first wind-up section 15*a*. In this state, when the first printing unit 11*a* is driven, only the single-side surface of the continuous web Wa is printed.

On the other hand, in substantially the same manner, the continuous web Wb is fed from the second web feed section 13*b* of the second printing unit 11*b* and then turned by 90 degrees by the second web feed side turning bar 17 to thereby pass through the second printing section 14*b* and then through the second wind-up section 15*a*. Thereafter, under this condition, when the second printing unit 11*b* is driven, the single-side surface of the continuous web Wb is printed.

(3) In the single-side surface multi-color printing, the continuous web Wa fed from the first web feed section 13*a* and passing through the first printing section 14*a* passes, as it is, the turn/transfer section 12 and the second web feed side turning bar 17, and passes through the second printing section 14*b* and the second wind-up section 15*b*. In this state, when both the printing units 11*a*, 11*b* are driven, the multi-color printing is effected on the single-side surface of the continuous web Wa at both the printing sections 14*a*, 14*b*.

In this second embodiment, as in the first embodiment, the printing sections 14*a*, 14*b* of the first and second printing units 11*a*, 11*b* are equipped with printing devices 5 and dryers 6, respectively. Further, the respective printing units 11*a*, 11*b* are equipped with servo-motors for driving, which are controlled by drive-control devices, not shown, so as to perform sectional driving operations, respectively.

Further, the wind-up sections 4*a*, 4*b* and 15*a*, 15*b* in both the first and second embodiments may be substituted with folding devices or sections so as to carry out folding treatment of the continuous webs Wa and Wb from the printing sections 3*a*, 3*b* and 14*a*, 14*b*, respectively.

It is further noted that, although the present invention is disclosed with reference to the preferred embodiments of the printing machine, the present invention is not limited to such specific embodiments, and many other applications will be apparent to those skilled in the art. Furthermore, it will obvious to experts in this art field to make various amendments, modifications and changes in the details of the illustrated and described embodiments so as to conform with a particular design or the like or with the necessity of the particular applications.

What is claimed is:

1. A printing machine comprising:

a first printing unit comprising a first web feed section, a first web printing section connected to the first web feed section, and a first web treating section connected to the first web printing section, wherein a single side surface of a continuous web can be printed at the first web printing section, wherein the first web feed section of the first printing unit is arranged at a position that is perpendicular to a printing direction in the first web printing section, and the web is fed from the first web feed section into the printing direction in the first web printing section through a turning bar for the first printing unit;

a second printing unit comprising a second web feed section, a second web printing section connected to the second web feed section, and a second web treating section connected to the second web printing section, wherein a single side surface of a continuous web can be printed at the second web printing section, wherein the second web feed section of the second printing unit is arranged at a position that is perpendicular to a printing direction in the second web printing section, and the web is fed from the second web feed section into the printing direction in the second web printing section through a turning bar for the second printing unit; and a turn/transfer section formed at a connecting portion between the first and second web printing sections, which are arranged in a linear line, so as to transfer the continuous web, printed at the first web printing section of the first printing unit, to the second web printing section of the second printing unit as it is or in a turned manner.

2. The printing machine according to claim 1, wherein each of the first and second web printing sections includes a printing device and a drier disposed downstream of the printing device.

3. The printing machine according to claim 1, wherein the first and second printing units are driven sectionally.

4. The printing machine according to claim 1, wherein the first and second web feed sections are disposed on the same side of the linear line.

5. The printing machine according to claim 4, wherein the first and second web treating sections are disposed on an opposite side of the linear line relative to the first and second web feed sections.

6. The printing machine according to claim 1, wherein the first web treating section is arranged in a position that is perpendicular to the printing direction in the first web printing section, and the second web treating section is arranged in a position that is perpendicular to the printing direction in the second web printing section.

7. The printing machine according to claim 6, wherein the first web treating section comprises a first windup section, and the second web treating section comprises a second windup section.

* * * * *